US011719055B2

(12) United States Patent
Gallagher et al.

(10) Patent No.: US 11,719,055 B2
(45) Date of Patent: Aug. 8, 2023

(54) MANAGED PRESSURE DRILLING SYSTEM AND METHOD

(71) Applicant: Kinetic Pressure Control, Ltd., Houston, TX (US)

(72) Inventors: Bobby Gallagher, Houston, TX (US); Robert Frith, Stafford Heights (AU)

(73) Assignee: Kinetic Pressure Control Ltd., Houston, TX (US)

( * ) Notice: Subject to any disclaimer, the term of this patent is extended or adjusted under 35 U.S.C. 154(b) by 172 days.

(21) Appl. No.: 17/413,542

(22) PCT Filed: Jan. 9, 2020

(86) PCT No.: PCT/US2020/012964

§ 371 (c)(1),
(2) Date: Jun. 12, 2021

(87) PCT Pub. No.: WO2020/146656

PCT Pub. Date: Jul. 16, 2020

(65) Prior Publication Data

US 2022/0010636 A1 Jan. 13, 2022

Related U.S. Application Data

(60) Provisional application No. 62/790,152, filed on Jan. 9, 2019.

(51) Int. Cl.

| | |
|---|---|
| ***E21B 21/08*** | (2006.01) |
| ***E21B 47/047*** | (2012.01) |
| ***E21B 21/06*** | (2006.01) |
| ***E21B 47/06*** | (2012.01) |

(52) U.S. Cl.
CPC ..... *E21B 21/08* (2013.01); *E21B 21/065* (2013.01); *E21B 47/047* (2020.05); *E21B 47/06* (2013.01)

(58) Field of Classification Search
CPC ..... E21B 21/08; E21B 21/065; E21B 47/047; E21B 47/06
See application file for complete search history.

(56) References Cited

U.S. PATENT DOCUMENTS 4,063,602 A 12/1977 Howell et al.
4,091,881 A 5/1978 Maus
(Continued)

FOREIGN PATENT DOCUMENTS

WO 2016134442 A1 9/2016
WO 2017096101 A1 6/2017

OTHER PUBLICATIONS

Written Opinion of the International Search Authority, International Application No. PCT/US2020/012964, dated May 28, 2020.
(Continued)

*Primary Examiner* — Brad Harcourt
(74) *Attorney, Agent, or Firm* — Victoy H. Segura

(57) ABSTRACT

A method for controlling pressure in a well includes pumping fluid into a riser extending between a drilling vessel and a wellhead, pumping fluid out of the riser to the drilling vessel by operating a first jet pump disposed in a conduit extending from the riser to the drilling vessel, wherein a rate of pumping power fluid into a power fluid inlet of the first jet pump is adjusted to maintain a liquid level in the drilling riser at a selected elevation.

22 Claims, 3 Drawing Sheets

(56) References Cited

U.S. PATENT DOCUMENTS

| | | | | |
|---|---|---|---|---|
| 6,668,943 | B1 * | 12/2003 | Maus | E21B 43/122 175/48 |
| 7,270,185 | B2 * | 9/2007 | Fontana | E21B 33/076 166/347 |
| 7,497,266 | B2 | 3/2009 | Fossli | |
| 8,403,059 | B2 * | 3/2013 | Hughes | E21B 21/001 166/344 |
| 2004/0007392 | A1 | 1/2004 | Judge et al. | |
| 2006/0045757 | A1 * | 3/2006 | Parr | E21B 43/124 417/76 |
| 2006/0157282 | A1 * | 7/2006 | Tilton | E21B 21/08 175/426 |
| 2007/0235223 | A1 | 10/2007 | Tarr | |
| 2011/0024195 | A1 | 2/2011 | Hoyer et al. | |
| 2011/0100710 | A1 | 5/2011 | Fossli | |
| 2012/0055678 | A1 * | 3/2012 | Humphreys | E21B 7/12 166/358 |
| 2012/0227978 | A1 * | 9/2012 | Fossli | E21B 21/001 166/363 |
| 2013/0032396 | A1 | 2/2013 | Stave | |
| 2018/0038177 | A1 | 2/2018 | Leuchtenberg | |
| 2018/0073314 | A1 * | 3/2018 | Reitsma | E21B 21/08 |
| 2018/0135368 | A1 * | 5/2018 | Stave | E21B 21/01 |
| 2020/0080392 | A1 * | 3/2020 | Bushman | E21B 21/106 |

OTHER PUBLICATIONS

International Search Report, International Application No. PCT/US2020/012964, dated May 28, 2020.

* cited by examiner

MANAGED PRESSURE DRILLING SYSTEM AND METHOD

CROSS REFERENCE TO RELATED APPLICATIONS

Continuation of International Application No. PCT/US2020/012964 filed on Jan. 9, 2020. Priority is claimed from U.S. Provisional Application No. 62/790,152 filed on Jan. 9, 2019. Both the foregoing applications are incorporated herein by reference in their entirety

BACKGROUND

This disclosure relates generally to methods and apparatus for offshore oil and gas well drilling. More specifically, this disclosure relates to methods and apparatus for allowing Managed Pressure Drilling (MPD) operations.

MPD is an adaptive drilling process used to precisely control the fluid pressure throughout the wellbore in the annular space between the drill string and the wellbore wall during drilling operations. The objective of MPD is to ascertain the downhole pressure environment limits and to manage the annular hydraulic pressure profile accordingly. The general categories of MPD known in the oil and gas industry include Dual Gradient Drilling (DGD), Constant Bottom Hole Pressure Drilling, Pressurized Mud Cap Drilling, Returns Flow Control drilling and Controlled Mud Level Drilling.

U.S. Pat. No. 4,091,881 issued to Maus discloses a method for controlling the liquid level of mud in a marine drilling riser. One or more flow lines are used to withdraw drilling fluid from the upper portion of the riser pipe. Gas is injected into the flow line/s to reduce drilling fluid density to provide lift. No mud return pumping system is used in this disclosure.

Howells, U.S. Pat. No. 4,063,602, discloses another method for controlling the liquid level of mud in a marine drilling riser. A fluid return pump is installed in the lower part of a marine drilling riser system. Return fluid from the well may be pumped back to the surface through a conduit or discharged to the ocean through an opening valve. The valve or the returns pump controls the fluid level in the riser. The disclosed system also may detect the pressure inside the riser and send an electrical signal in response.

U.S. Pat. No. 7,497,266 issued to Fossli discloses another method for controlling the liquid level of mud in a marine drilling riser. The arrangement described includes a surface blowout preventer (BOP) and a gas bleeding outlet at the upper end of the drilling riser, a lower BOP with a by-pass line, and an outlet at a chosen depth below the water surface that is connected to a pumping system with a flow return conduit running back to a drilling vessel. Managed pressure drilling systems such as those disclosed in U.S. Pat. No. 7,497,266 require electrical signals and electrical power to be transmitted to a subsea pumping system. Such systems may be complex and expensive. It would be more desirable to have a system where such complicated controls could be avoided and existing equipment on the drilling vessel used.

In Reitsma, International Patent Application Publication No. WO 2016/134442, another method and apparatus are described for controlling the liquid level of mud in riser. The apparatus described includes a fluid outlet in a marine drilling riser which is connected to the inlet of an ejector assembly to return drilling fluid to a drilling platform on the water surface. The method includes pumping drilling fluid into a drill string extending from the drilling platform into the wellbore and at least one of, (i) introducing fluid into a power fluid inlet of the ejector assembly at a rate selected to remove fluid from the wellbore fluid outlet at a selected rate and (ii) operating a controllable flow restriction in a flow path from the wellbore fluid outlet to the working fluid inlet of the ejector assembly, in order to maintain a selected wellbore pressure.

In Controlled Mud Level drilling, a subsea mud lift pump is coupled to the interior of the riser at a chosen level above the water bottom but below the water surface, and a mud return line is used to circulate the drilling mud back to the surface. This allows the fluid level in the riser to be controlled at any elevation above the location of the connection to the subsea mud lift pump. A commercially available example of such a Controlled Mud Level Drilling system is sold under the trademark EC-Drill, which is a trademark of Enhanced Drilling, AS, Straume, Norway. While such systems offer many benefits such as the ability to manage bottom hole pressure and reduced ECD (Equivalent Circulating Density) effects, these systems require significant modifications to drilling vessels and drilling operating procedures before they can be used. Such modifications can be prohibitively expensive and often cannot be accomplished while the drilling vessel is working. In addition, these systems require power and control input for subsea pumps, adding to the expense and complexity of the system. Most drilling vessels are therefore unable to support MPD activities without a major retrofit. It is desirable to have an MPD system that requires little to no vessel modifications and does not require subsea electrical power and control to be supplied to a subsea pump.

SUMMARY

A method for controlling pressure in a well according to one aspect of the present disclosure includes pumping fluid into a riser extending between a drilling vessel and a wellhead, pumping fluid out of the riser to the drilling vessel by operating a first jet pump disposed in a conduit extending from the riser to the drilling vessel, wherein a rate of pumping power fluid into a power fluid inlet of the first jet pump is adjusted to maintain a liquid level in the drilling riser at a selected elevation.

Some embodiments further comprise pumping gas into a mud return line extending from a working fluid outlet of the jet pump to the drilling vessel.

Some embodiments further comprise connecting an auxiliary line associated with the riser to a power fluid inlet of the first jet pump and pumping power fluid through the auxiliary line.

Some embodiments further comprise adjusting a rate of pumping the power fluid to maintain the liquid level at a selected elevation.

In some embodiments, the selected elevation corresponds to a selected equivalent circulating density.

Some embodiments further comprise adjusting a setting of an iris type annular pressure control device disposed in the riser in an annular space between the riser and a drill string disposed in the riser to increase back pressure on the well.

Some embodiments further comprise filtering cuttings exceeding a selected size from fluid entering a working fluid inlet of the first jet pump.

Some embodiments further comprise pumping gas into a power fluid inlet of a second jet pump having a working fluid inlet in communication with a working fluid outlet of the first jet pump, the second jet pump having a working fluid outlet in fluid communication with the conduit.

In some embodiments, the pumping fluid into the riser comprises pumping fluid into a drill string extending through the riser into the well below the bottom of the riser such that the pumped fluid exits the drill string and enters an annular space between the riser and the drill string.

A managed pressure drilling system according to another aspect of this disclosure includes a riser extending from a subsea well to a platform on the surface of a body of water. The riser has a fluid port at a selected position above the subsea well and below the surface. The fluid port is in fluid communication with a working fluid inlet of a first jet pump. A second jet pump has a fluid inlet in fluid communication with a fluid outlet of the first jet pump. An outlet of the second jet pump is in fluid communication with a fluid processing system on the platform. A power fluid pump is disposed on the platform and is in fluid communication with a power fluid inlet of the first jet pump. A gas source is disposed on the platform and is in fluid communication with a power fluid inlet of the second jet pump, wherein the power fluid pump and the gas source are controllable such that a fluid level in the riser is maintained at a selected elevation.

Some embodiments further comprise a fluid level sensor in the riser.

In some embodiments, the fluid level sensor comprises a pressure sensor.

Some embodiments further comprise a controller in signal communication with the fluid level sensor. The controller provides control output to operate the power fluid pump and the gas source in response to signals from the fluid level sensor to maintain the fluid level at the selected elevation.

Some embodiments further comprise a drilling fluid pump disposed on the platform and connected at an outlet to a drill string extending into the riser.

Some embodiments further comprise valves connected to the power fluid inlet, the working fluid inlet and the fluid outlet of the first jet pump. The valves are operable to cause fluid to flow into the fluid outlet of the first jet pump. The valves are operable to bypass the first jet pump, and the valves are operable to direct fluid flow from the port to the working fluid inlet of the first jet pump and fluid flow from the fluid outlet of the first jet pump to the working fluid inlet of the second jet pump.

Some embodiments further comprise at least one valve connected between a riser kill line and the power fluid inlet of the first jet pump wherein power fluid to operate the first jet pump is moved through the kill line.

Some embodiments further comprise at least one valve disposed in a choke line extending from the subsea well to the fluid outlet of the first jet pump, and at least one valve disposed in a return line extending from the fluid outlet of the first jet pump to the working fluid inlet of the second jet pump, wherein the choke line is operable as a drilling fluid return line from the riser port to the platform.

Some embodiments further comprise a rock catcher and separator disposed in a fluid line connecting the port and the working fluid inlet of the first jet pump.

Some embodiments further comprise an annular control device operable to close an annular space in the riser between the riser and a pipe string disposed in the riser, wherein the power fluid pump is operable to maintain a selected pressure in the subsea well when a drilling fluid pump in pressure communication with a pipe disposed in the riser is switched off.

Other aspects and possible advantages will be apparent from the description and claims that follow.

DETAILED DESCRIPTION

Figure 1:
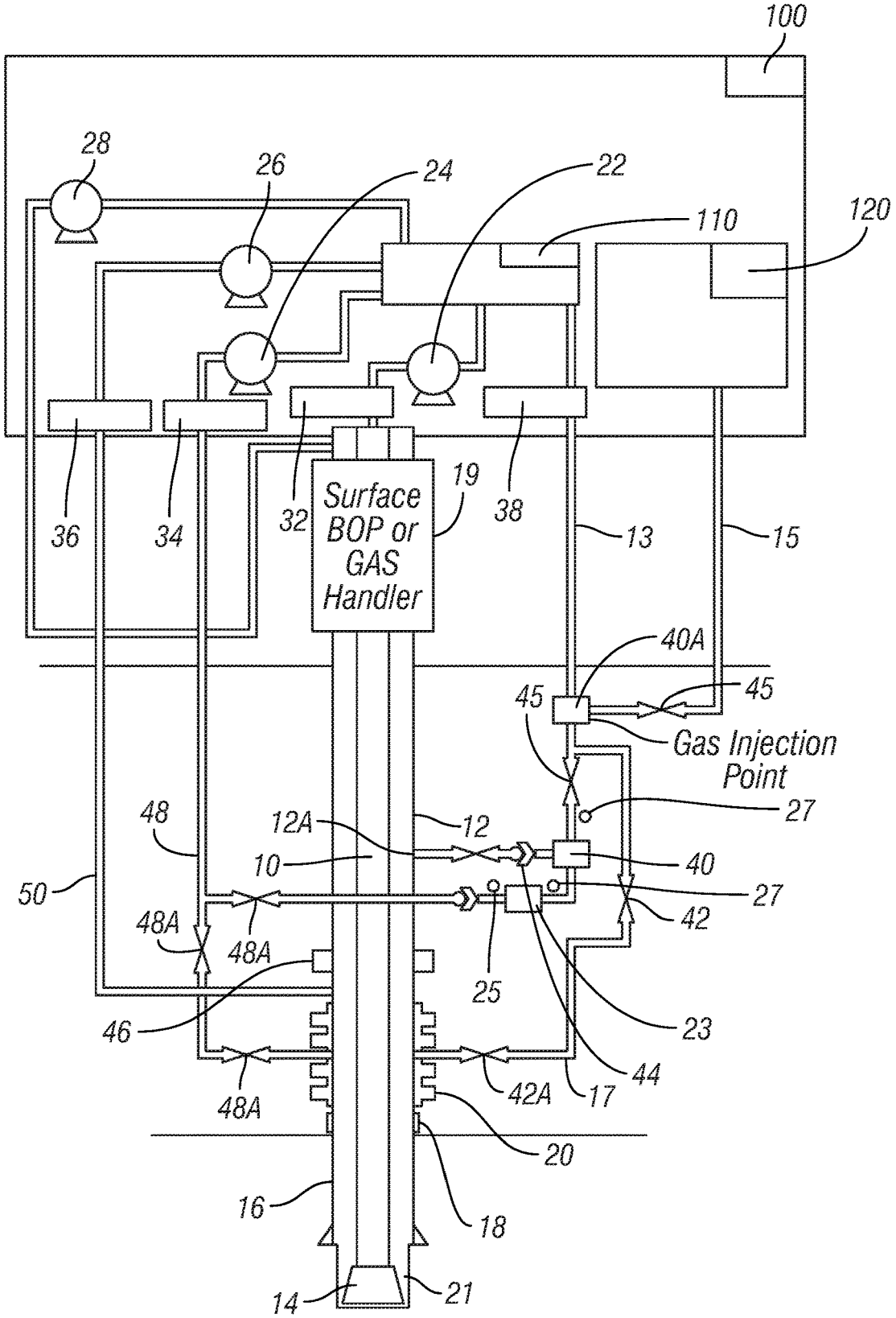
FIG. 1 shows a schematic diagram of an example embodiment of a managed pressure drilling (MPD) system according to the present disclosure.

Illustrative embodiments are disclosed herein. In the interest of clarity, not all features of an actual implementation are described. In the development of any such actual implementation, numerous implementation-specific decisions may need to be made to obtain design-specific goals, which may vary from one implementation to another. It will be appreciated that such a development effort, while possibly complex and time-consuming, would nevertheless be a routine undertaking for persons of ordinary skill in the art having the benefit of this disclosure. The disclosed embodiments are not to be limited to the precise arrangements and configurations shown in the figures, in which like reference numerals may identify like elements. Also, the figures are not necessarily drawn to scale, and certain features may be shown exaggerated in scale or in generalized or schematic form, in the interest of clarity and conciseness.

Example embodiments of a managed pressure control system according to the present disclosure may include the following components shown schematically in FIG. 1. A first jet pump 40, which may use liquid as a power fluid, has a power fluid inlet, a working fluid inlet and a working fluid outlet. The first jet pump 40 may take its power fluid input from an auxiliary line such as a kill line 48, which may be one of the auxiliary lines ordinarily associated with a drilling riser 12 (or other conduit). The working fluid inlet is connected to the riser 12 main tube. Varying the power fluid flow rate allows the amount of fluid that is drawn from the riser 12 and discharged to a return line 13 that extends to a drilling platform 100 disposed on or above the surface of a body of water. By either increasing or decreasing the power fluid flow, a level of liquid in the riser 12 main tube can be adjusted and controlled.

A second jet pump 40A, which may use gas as a power fluid may have its power fluid inlet connected to a gas injection line 15 extending to a gas source, e.g., a gas injection system 120, disposed on the platform 100. The working fluid inlet may be connected to the working fluid outlet (i.e., the discharge) of the first jet pump 40. Varying the working fluid (gas) flow rate can affect the working fluid inlet pressure of the second jet pump 40A. Changing the working fluid inlet pressure of the second jet pump 40A can change the performance characteristics of the first jet pump 40.

The kill line 48 may be an existing external conduit that is present on most offshore drilling vessels using a drilling riser. The kill line 48 in the present embodiment can be used to provide power fluid for the first jet pump 40. In some embodiments, a separate conduit may be used in place of or in addition to the kill line 48. A bypass arrangement around the first jet pump 40, for example using valves 48A as shown in FIG. 1, allows the kill line 48 to be used in a known manner, e.g., during well pressure control operations in addition to being used as the power fluid conduit for the first jet pump 40.

An auxiliary line such as a choke line 17 (shown connected between a BOP stack 20 and the outlet or discharge of the second jet pump 40A) may be an existing riser external line that is present on offshore drilling vessels using a drilling riser. The choke line 17 can be used to provide a mud return flow conduit, e.g., through a return line 13, from the outlet of the second jet pump 40A to a mud return inlet of a drilling mud system 110 located on the platform 100. In some embodiments, a separate conduit (not shown) may be used in substitution of or in addition to the choke line 17 and return line 13. Bypass arrangement around the second jet pump 40A may be provided, such as by valves including valve 42, 42A and 45 to enable ordinary use of the choke line 17 during well control operations.

The subsea blowout preventer (BOP) stack 20 may be an existing subsea BOP stack comprised of pipe rams, shear rams and annular well closure devices. The BOP stack 20 may contain one or more wellbore pressure sensors.

An iris type annular pressure control device 46 may be used to control fluid pressure in the riser 12 in the annular space between the riser 48 and a drill string 10. The annular pressure control device may be similar to a device described in U.S. Patent Application Publication No. 2017/0211707 filed by Wakayama et al.

The drilling mud system 110 may be any mud system known in the art to be used on marine drilling vessels and may comprise solids and gas separators, mud pits, pump(s) 22, pressure sensor(s), a flow meter 32, level sensors and mud conditioning equipment.

The gas injection system 120 may provide gas under pressure (e.g., 5,000 psi but in some embodiments as much as 15,000 psi), for example, nitrogen gas, and may comprise gas storage bottles and pressure regulation equipment (none shown separately). Some embodiments may include gas compression and nitrogen generator(s).

The riser 12 is a conduit known in the art that connects the subsea BOP stack 20 to the platform 100 and may be used to assist with mud return from the well 21 to the platform 100.

A surface BOP and riser gas handler as shown in FIG. 1 may be used in some embodiments to provide well pressure control for situations involving severe fluid influx (kicks) or to handle continuous gas generation which can occur with under balanced drilling.

Flow meters 32, 34, 36 and 38 may be used to measure the flow of fluid (mud) into and out of the well 21 as shown as they are respectively connected in FIG. 1. The flow meters may measure volumetric flow and/or mass flow.

Pumps disposed on the drilling platform 100 may comprise mud pump(s) 22 of any known type that are installed on drilling vessels. The pumps may be positive displacement type pumps or centrifugal pumps. A fill pump 28 provides a flow of fluid, e.g., drilling mud to cool a riser slip joint and ensures liquid level in the riser 12 remains above the riser connection 12A to the second jet pump 40A inlet. A riser boost pump 26 may be used to provide additional liquid flow into the riser 12 at a selected position through a riser boost line 50, generally proximate the bottom of the riser 12 to assist in lifting drill cuttings to the platform 100. A jet pump power fluid pump 24 (feed pump) may provide power fluid to the first jet pump 40, e.g., through the kill line 48.

A well head 18 provides a structural and pressure-containing interface for the drilling operations and may be connected to the bottom of the BOP stack 20 and to the top of a well casing 16.

A rock catcher and separator 23 (rock catcher) may be provided to ensure that drill cuttings that are larger than the throat clearance in the first jet pump 40 do not enter the first jet pump 40. The rock catcher and separator may have inlet 25 and outlet 27 pressure sensors which enable detecting blockage (as a result of increased pressure difference across the rock catcher 23). The rock catcher 23 may also have an additional sensor (not shown) for determining if it is full of cuttings, such as a density sensor (not shown). Embodiments of the rock catcher 23 may include:

(i) a rock catcher and separator that is sized to be large enough to handle all expected large cutting for an entire well program; and (ii) a rock catcher and separator that has a container for cuttings that can be retrieved and replaced by a Remotely Operable Vehicle (ROV) (not shown).

A valve 45 on the outlet of the first jet pump 40 can be selectively closed so that the power fluid is forced back through the working fluid inlet of the first jet pump 40. This allows for debris and blockages to be cleared from the first jet pump 40.

Because jet pumps have no moving parts to experience mechanical wear, they can operate for several years at a low risk of failure and with minimal maintenance requirements. They also tend to be more rugged and tolerant of corrosive and abrasive well fluids. Jet pumps can handle significant volumes of free gas.

Figure 2:
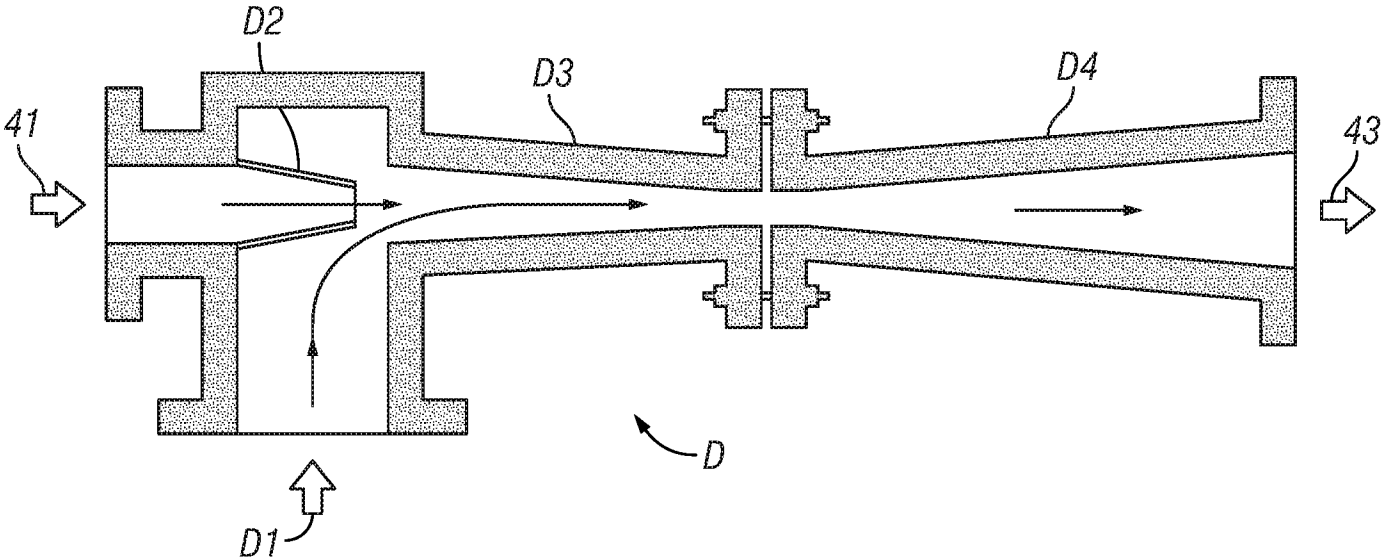
FIG. 2 shows a cross-section of an example embodiment of a jet pump.

An example jet pump D, such as may be used for the first jet pump (40 in FIG. 1) and the second jet pump (40A in FIG. 1) is shown in more detail in FIG. 2. The jet pump D may comprise a diffuser having a converging inlet diffuser D3 and a diverging outlet diffuser D4. An outlet of the converging outlet diffuser D4 may be coupled through a return line to the mud system (110 in FIG. 1). A working fluid inlet 41 to the jet pump D may be in fluid communication with the wellbore fluid outlet (e.g., through a check or non-return valve 44 in FIG. 1). Power or motive fluid may enter the jet pump D through a power fluid inlet. The power fluid may be supplied by pump 24 in FIG. 1 for the first jet pump (40 in FIG. 1) or from the gas source (120 in FIG. 1) for the second jet pump (40A in FIG. 1). The power fluid is discharged in the interior of the ejector assembly D upstream of the converging diffuser D3 through a nozzle D2. The nozzle D2 serves to increase velocity of the power fluid so as to reduce fluid pressure at the working fluid inlet D1. A combination of the power fluid and the working fluid, e.g., the drilling fluid, maybe returned to the drilling platform (100 in FIG. 1) through a fluid return line.

The pressure at a diffuser outlet 43 (discharge) is related to the discharge static head and the discharge friction head. The discharge static head is related to fluid density. The fluid density can be reduced, for example, by injecting lower density fluids or gases into the fluid present at the discharge 43. If a gas, such as nitrogen, is injected into the discharge line (e.g., 13 in FIG. 1) the operating point of the jet pump will be changed. Thus, adding gas into the jet pump discharge allows for the performance of the jet pump to be controlled, and such principle is used according to the present disclosure for the second jet pump (40A in FIG. 1).

Managed pressure drilling systems and methods known in the art such as are disclosed in International Application Publication No. WO 2016/134442 filed by Reitsma et al. include using a jet pump for controlling the level of mud in a drilling riser. However, the foregoing application publication does not disclose an apparatus or method for handling large drill cuttings and/or high volume of drill cuttings. Large drill cuttings can introduce operating difficulties in a jet pump as they rely on small nozzle and annular throat diameters (e.g., approximately 1 inch for deep water drilling applications). It is likely that that drill cuttings exceeding this size may be present during drilling operations; without an effective means of dealing with such drill cuttings the jet pump will fail in its purpose of controlling mud level in the riser. The present disclosure provides a system able to handle large cuttings through the use of the rock catcher and separator (23 in FIG. 1) on the inlet from the riser (12 in FIG. 1) into the working fluid inlet of the first jet pump (40 in FIG. 1).

Referring once again to FIG. 1, a way to improve the performance of the first jet pump 40 comprises operating the second jet pump 40A such that the working fluid inlet of the second jet pump 40A is coupled to the working fluid outlet of the first jet pump 40. Having the second, gas-operated jet pump 40A coupled to the working fluid outlet of first jet pump 40 can reduce back pressure at the working fluid outlet of the first jet pump 40. Reduced back pressure allows increased performance of the first jet pump 40 to be obtained utilizing the mud pump(s) 22 on the drilling vessel or platform 100. Adding additional mud pumps to a drilling vessel may be cost prohibitive, and by using jet pumps as explained herein, a MPD system may provide capability to obtain extra performance out of existing drilling vessel equipment.

Figure 3:
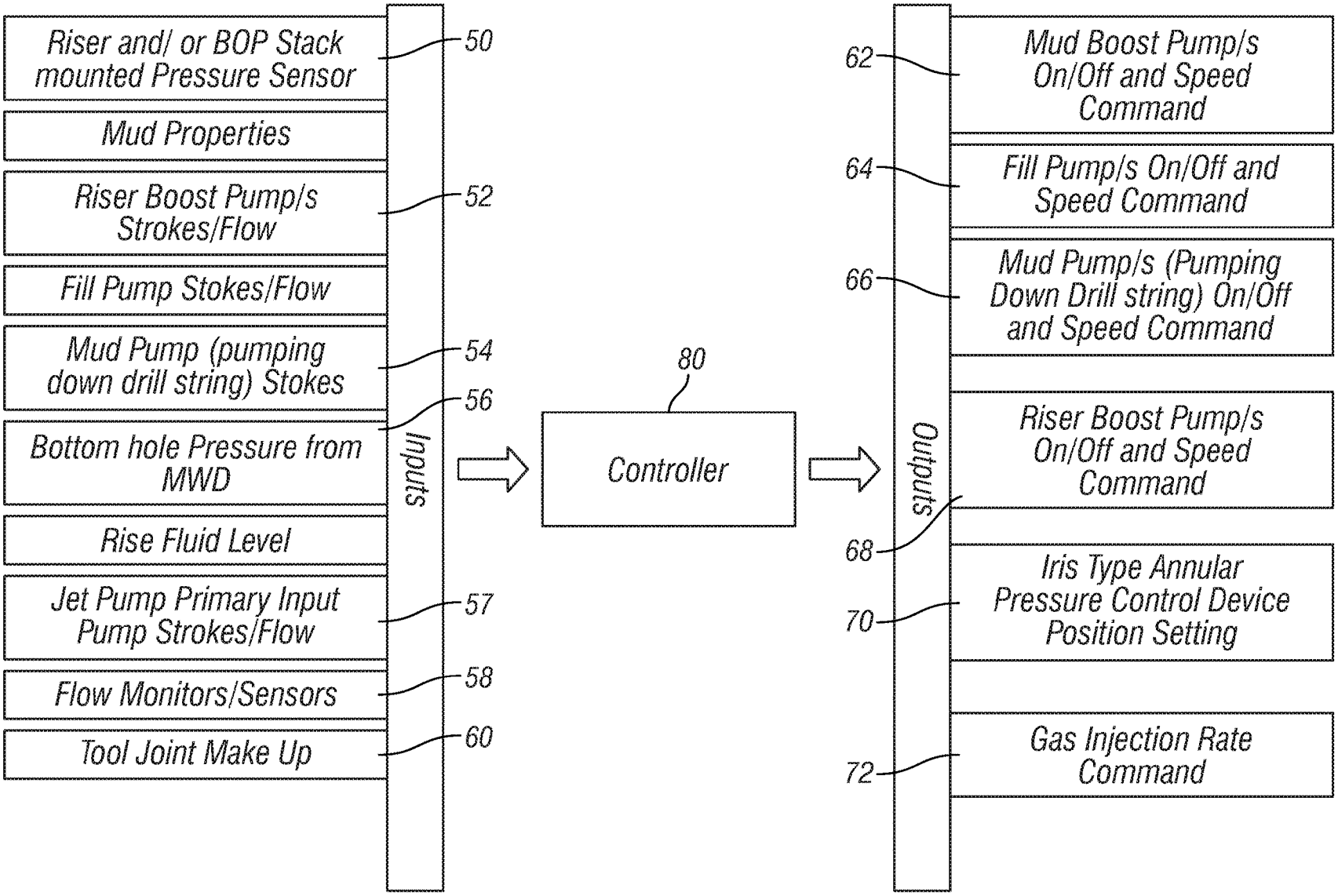
FIG. 3 shows a functional block diagram of an automatic control according to the present disclosure.

In some embodiments, and referring now to FIG. 3, methods according to the present disclosure may be implemented automatically. Sensors for measuring certain parameters may be in signal communication with a controller or processor 80. The processor 80 may be, for example, a microprocessor, microcontroller, programmable logic controller or any other device capable of controlling operation of one or more output devices in response to measurements made by one or more sensors. The sensors may comprise one or more pressure sensors 50 in fluid communication with the riser (12 in FIG. 1) to provide measurements related to pressure in the wellbore and fluid level in the riser. Flow and/or pump operating rate sensors 52 may be provided for the riser boost pump(s) (24 in FIG. 1), for the rig mud pump(s) (22 in FIG. 1) at 54, for the riser fill pump (28 in FIG. 1) at 57, for riser fluid level at 56, for flow rate at 58 and for drill string segment connection and disconnection at 60. The controller 80 may comprise programming and/or embedded instructions to control operation of the riser boost pump at 62, the riser fill pump at 64, the rig mud pump(s) at 66, the annular pressure control device at 70 and a control rate signal for the gas injection system at 72. Control of the foregoing components of the system may be performed according to various methods described below.

Methods according to the present disclosure for operating a MPD system may comprise the following. Particular components of the drilling system referred to by number in the following description may be observed in FIG. 1.

Method 1: Maintaining constant bottom hole pressure (CBHP) during "drilling ahead" (lengthening the well 21) whether drilling over balanced, balanced or under balanced. Over balanced means the fluid pressure in the well exceeds fluid pressure of exposed formations penetrated by the well 21. Balanced means that the well fluid pressure is the same as the formation fluid pressure, and under balanced means that the well fluid pressure is less than the formation fluid pressure.

a. Drilling fluid (e.g., mud) is pumped through the drill string 10 and through drill bit 14 by the mud pump(s) 22. Mud is returned from the well 21 through the annular space between the drill string 10 and the wellbore wall, into the wellbore/casing 16 and to the wellhead 18. Such returning mud moves above the wellhead 18, into the BOP stack 20 and into the riser 12. The mud in the riser 12 may be returned to the platform 100 through the connection 12A to the working fluid inlet of the first jet pump 40, then from the working fluid outlet of the first jet pump 40 to the working fluid inlet of the second jet pump 40A. The mud may then move from the working fluid outlet of the second jet pump 40A to the return line 13, then back to the mud system 110 on the platform 100. Depending on the operating rates of the rig mud pump(s) 22 and operating rates of the first and second jet pumps 40, 40A, the mud will establish a liquid level in the riser 12 above the connection 12A.

b. The level of mud in the riser 12 is determined, for example, by measurements of pressure from pressure sensors, mud properties and/or liquid level sensors in fluid communication with the interior of the riser 12. Such sensors (not shown separately) may be in signal communication with the controller (80 in FIG. 3) The level of mud in the riser 12, mud properties and sensor inputs are used by the controller (80 in FIG. 3) to calculate an equivalent circulating density (ECD) of the mud. ECD, as is known in the art, is the fluid pressure that would be obtained by a static column of liquid having a particular density, wherein such pressure is the actual pressure of flowing mud at the same true vertical depth in the well 21. Thus, the ECD of flossing mud may be greater than the actual density of the mud as a result of friction pressure when the mud is flowing.

c. In order to keep the level of mud in the riser 12 at a chosen elevation, and thereby maintain a selected fluid pressure (CBHP and/or ECD) in the well 21, the jet pump power fluid flow can be adjusted, e.g., by changing operating rate of the feed pump 24. Such adjustment will result in corresponding changes in the flow rate of the first jet pump 40, and consequently, the riser liquid level will be raised or lowered.

d. For additional mud level control, the mud pump(s) 22 can have their flow rate adjusted to result in the riser liquid level being raised or lowered correspondingly.

e. For still additional mud level control, the riser boost pump 26 my introduce mud into the boost line 50 and then into the lower portion of the riser 12. The riser boost pump 26 can have its flow rate adjusted to result in the riser liquid level being raised or lowered correspondingly.

f. For still additional mud level control, gas is injected into the first jet pump 40 discharge line to change the first jet pump 40 outlet pressure and thereby the flow rate from the first jet pump 40. Such adjustment will result in the riser liquid level being raised or lowered correspondingly.

g. The iris type annular pressure control device 46 can be operated between its open and closed position, which would result in increasing or decreasing back pressure on the returning mud flow in the annular space in the riser 12 around the drill string 10.

Method 2: Maintaining constant bottom hole pressure (CBHP) and ECD during tool joint (drill string segment) connections. During drilling operations, it is necessary from time to time to lengthen the drill string 10 by coupling therein one or more additional segments of drill pipe and/or drilling tools. During operations to retrieve the drill bit 14 for service or replacement, the entire drill string 10 may be removed from the well 21. During such "making or breaking connections" operations, the rig mud pump(s) 22 are switched off and hydraulic connection between the mud pump(s) 22 and the drill string 10 are temporarily broken.

a. The level of mud in the riser 12 may be determined by pressure sensors, mud properties and/or liquid level sensors. The level of mud in the riser, mud properties and sensor inputs are used to calculate ECD. Mud that was being pumped down the drill string 10 during tool joint make up (i.e., connection/disconnection of drill string segments) is stopped. This action provides a signal to the controller (80 in FIG. 3).

b. The riser mud boost line 50 flow rate is increased by the increasing speed of the riser boost pump 26. In some instances, such speed is increased by an amount that provides mud flow equal to that which was previously being pumped by the mud pump(s) 22 through the drill sting 10.

c. Because the mud from the riser boost line 50 is not being pumped through the drill bit 14, back pressure related to the flow of mud in the annular space around the drill string 10 between the drill bit 14 and the well head 18 is not acting on the formations exposed by the drill bit 14. To compensate for this, the setting of the iris type annular pressure control device 46 may be changed. Pressure measurements from a BOP stack 20 mounted pressure sensor or a measurement while drilling (MWD) based downhole pressure sensor may be used as input to the controller (80 in FIG. 3) to ensure ECD is kept substantially constant, e.g., by maintaining liquid level in the riser 12 substantially constant. In order to keep the level of mud in the riser constant, the operating rate of the feed pump 24 that supplies power fluid to the first jet pump 40 can be adjusted. Such adjustment will result in the riser 12 liquid level being raised or lowered.

d. For still additional control, gas may be injected into the first jet pump discharge line to change the first jet pump 40 outlet pressure and thereby the flow from the first jet pump 40. Such adjustment will result in the riser liquid level being raised or lowered.

Method 3: Isolate the first jet pump during well control operations.

Using the choke line 17 and the kill line 48 for the primary input fluid injection and output return line to the drilling vessel 100 means that these lines are unavailable to support well control operations while the first jet pump 40 is in use. To address this limitation, isolation valves are provided around the first jet pump 40 as shown in FIG. 1. Once the isolation valves are closed, the first jet pump 40 is isolated from the choke line 17, and the choke line 17 becomes available for well control operations. In addition, to make the kill line 48 available for well control operations, a valve on the inlet to the first jet pump 40 can be closed and an in-line valve opened to make the kill line 48 available for well control operations.

Method 4: Clear blockages and debris from the first jet pump.

In instances where drill cuttings, rocks, sediment or other debris obstruct the first jet pump 40, such obstructions can be cleared by closing a jet pump outlet valve while continuing to pump fluid into the first jet pump 40 power fluid inlet. This action will cause reverse flow through the first jet pump 40 to remove any obstruction. Obstruction may be detected by flow measurement or by using pressure sensors in fluid communication with the working fluid inlet and the working fluid outlet of the first jet pump 40.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A method for controlling pressure in a well, comprising:

pumping fluid into a riser extending between a drilling vessel and a wellhead;

pumping fluid out of the riser to the drilling vessel by operating a first jet pump disposed in a conduit extending from the riser to the drilling vessel;

pumping gas into a power fluid inlet of a second jet pump having a working fluid inlet in communication with a working fluid outlet of the first jet pump, the second jet pump having a working fluid outlet in fluid communication with the conduit; and wherein a rate of pumping power fluid into a power fluid inlet of the first jet pump is adjusted to maintain a liquid level in the drilling riser at a selected elevation.

2. The method of claim 1 further comprising pumping gas into a mud return line extending from a working fluid outlet of the first jet pump to the drilling vessel.

3. The method of claim 1 further comprising connecting an auxiliary line associated with the riser to a power fluid inlet of the first jet pump and pumping power fluid through the auxiliary line.

4. The method of claim 3 further comprising adjusting a rate of pumping the power fluid to maintain the liquid level at a selected elevation.

5. The method of claim 1 wherein the selected elevation corresponds to a selected equivalent circulating density.

6. The method of claim 1 wherein the selected elevation corresponds to a selected pressure in the wellbore.

7. The method of claim 1 further comprising adjusting a setting of an iris type annular pressure control device disposed in the riser in an annular space between the riser and a drill string disposed in the riser to increase back pressure on the well.

8. The method of claim 1 further comprising filtering cuttings exceeding a selected size from fluid entering a working fluid inlet of the first jet pump.

9. The method of claim 1 further comprising adjusting a rate of the pumping gas to maintain the liquid level at the selected elevation.

10. The method of claim 1 wherein the pumping fluid into the riser comprises pumping fluid into a drill string extending through the riser into the well below the bottom of the riser such that the pumped fluid exits the drill string and enters an annular space between the riser and the drill string.

11. The method of claim 1 further comprising closing an iris type annular pressure control device disposed in the riser in an annular space between the riser and a drill string disposed in the riser to maintain fluid pressure in the well during connecting and disconnecting of segments of a drill string extending through the riser.

12. The method of claim 1 further comprising inducing reverse fluid flow in the first jet pump to remove obstructions therefrom.

13. A managed pressure drilling system, comprising:

a riser extending from a subsea well to a platform on the surface of a body of water, the riser having a fluid port at a selected position above the subsea well and below the surface, the fluid port in fluid communication with a working fluid inlet of a first jet pump;

a second jet pump having a fluid inlet in fluid communication with a fluid outlet of the first jet pump, an outlet of the second jet pump in fluid communication with a fluid processing system on the platform;

a power fluid pump disposed on the platform and in fluid communication with a power fluid inlet of the first jet pump; and a gas source disposed on the platform and in fluid communication with a power fluid inlet of the second jet pump, wherein the power fluid pump and the gas source are controllable such that a fluid level in the riser is maintained at a selected elevation.

14. The system of claim 13 further comprising a fluid level sensor in the riser.

15. The system of claim 14 wherein the fluid level sensor comprises a pressure sensor.

16. The system of claim 14 further comprising a controller in signal communication with the fluid level sensor, the controller providing control output to operate the power fluid pump and the gas source in response to signals from the fluid level sensor to maintain the fluid level at the selected elevation.

17. The system of claim 13 further comprising a drilling fluid pump disposed on the platform and connected at an outlet to a drill string extending into the riser.

18. The system of claim 13 further comprising valves connected to the power fluid inlet, the working fluid inlet and the fluid outlet of the first jet pump, the valves operable to cause fluid to flow into the fluid outlet of the first jet pump, the valves operable to bypass the first jet pump and the valves operable to direct fluid flow from the port to the working fluid inlet of the first jet pump and fluid flow from the fluid outlet of the first jet pump to the working fluid inlet of the second jet pump.

19. The system of claim 18 further comprising at least one valve connected between a riser kill line and the power fluid inlet of the first jet pump wherein power fluid to operate the first jet pump is moved through the kill line.

20. The system of claim 18 further comprising at least one valve disposed in a choke line extending from the subsea well to the fluid outlet of the first jet pump, and at least one valve disposed in a return line extending from the fluid outlet of the first jet pump to the working fluid inlet of the second jet pump, wherein the choke line is operable as a drilling fluid return line from the riser port to the platform.

21. The system of claim 13 further comprising a rock catcher and separator disposed in a fluid line connecting the port and the working fluid inlet of the first jet pump.

22. The system of claim 13 further comprising an annular control device operable to close an annular space in the riser between the riser and a pipe string disposed in the riser, wherein the power fluid pump is operable to maintain a selected pressure in the subsea well when a drilling fluid pump in pressure communication with a pipe disposed in the riser is switched off.

* * * * *